US012507859B2

(12) United States Patent
Kremmel et al.

(10) Patent No.: US 12,507,859 B2
(45) Date of Patent: Dec. 30, 2025

(54) DAMPENING TUB SUPPORT FOR A DISHWASHER APPLIANCE

(71) Applicant: Haier US Appliance Solutions, Inc., Wilmington, DE (US)

(72) Inventors: Aldo Vincent Kremmel, Palmyra, IN (US); Kyle James Brewer, Louisville, KY (US); Rocco Cordaro, Louisville, KY (US); Zachary Wiles, Louisville, KY (US); Senthil Nathan Jaganathan, Louisville, KY (US); Sheng-Yuan Hsu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/441,776

(22) Filed: Feb. 14, 2024

(65) Prior Publication Data

US 2025/0255453 A1 Aug. 14, 2025

(51) Int. Cl.
*A47L 15/42* (2006.01)

(52) U.S. Cl.
CPC ..... *A47L 15/4272* (2013.01)

(58) Field of Classification Search
CPC ..... A47L 15/4268; A47L 15/4272
USPC ..... 312/228, 351.7
See application file for complete search history.

(56) References Cited

U.S. PATENT DOCUMENTS

| | | | | |
|---|---|---|---|---|
| 3,049,260 | A * | 8/1962 | Stone | B65D 81/056 217/53 |
| 5,358,323 | A | 10/1994 | Ripley | |
| 7,004,440 | B2 | 2/2006 | Williams et al. | |
| 7,014,160 | B2 * | 3/2006 | Muyskens | D06F 39/001 206/592 |
| 9,845,564 | B2 * | 12/2017 | Maderic | D06F 39/001 |
| 10,136,792 | B2 * | 11/2018 | Bak | B65D 85/68 |
| 2009/0205378 | A1 | 8/2009 | Helgesen | |
| 2020/0305681 | A1 | 10/2020 | Dirisala et al. | |

FOREIGN PATENT DOCUMENTS

| | | | |
|---|---|---|---|
| EP | 1956263 | B1 | 8/2010 |
| KR | 101397000 | B1 | 5/2004 |

* cited by examiner

*Primary Examiner* — James O Hansen
(74) *Attorney, Agent, or Firm* — Dority & Manning, P.A.

(57) ABSTRACT

A dishwasher appliance includes an apron frame, a wash tub positioned on top of the apron frame and defining a wash chamber for receipt of a load of articles, and a dampening tub support positioned between the apron frame and the wash tub. The dampening tub support includes a mounting structure that is attached to the apron frame and defines a tub support surface for supporting the wash tub and a resilient member lining the tub support surface between the mounting structure and the wash tub.

20 Claims, 7 Drawing Sheets

DAMPENING TUB SUPPORT FOR A DISHWASHER APPLIANCE

FIELD OF THE INVENTION

The present subject matter relates generally to dishwasher appliances, and more particularly, to systems for supporting a wash tub of a dishwasher appliance.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Notably, impacts to the cabinet may be experienced during the transportation and installation of the dishwasher appliance. These impacts may transmit through the cabinet and to the wash tub, which is typically made of a thin metal or plastic. These forces may dent or damage the wash tub, resulting in cosmetic defects, operability issues, and/or leaks. These issues may require service calls, may result in customer dissatisfaction or damage to the appliance or surrounding property, and may incur additional maintenance costs.

Accordingly, a dishwasher appliance including features for reducing the effects of transportation damage would be desirable. More specifically, features that reduce damage associated with cabinet or wash tub impacts and undesirable vibrations would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dishwasher appliance is provided including an apron frame, a wash tub positioned on top of the apron frame and defining a wash chamber for receipt of a load of articles, and a dampening tub support positioned between the apron frame and the wash tub. The dampening tub support includes a mounting structure that is attached to the apron frame and defines a tub support surface for supporting the wash tub and a resilient member lining the tub support surface between the mounting structure and the wash tub.

In another exemplary embodiment, a wash tub support assembly for a dishwasher appliance is provided. The dishwasher appliance includes a wash tub defining a wash chamber for receipt of a load of articles. The wash tub support assembly includes an apron frame and a dampening tub support positioned between the apron frame and the wash tub. The dampening tub support includes a mounting structure that is attached to the apron frame and defines a tub support surface for supporting the wash tub and a resilient member lining the tub support surface between the mounting structure and the wash tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
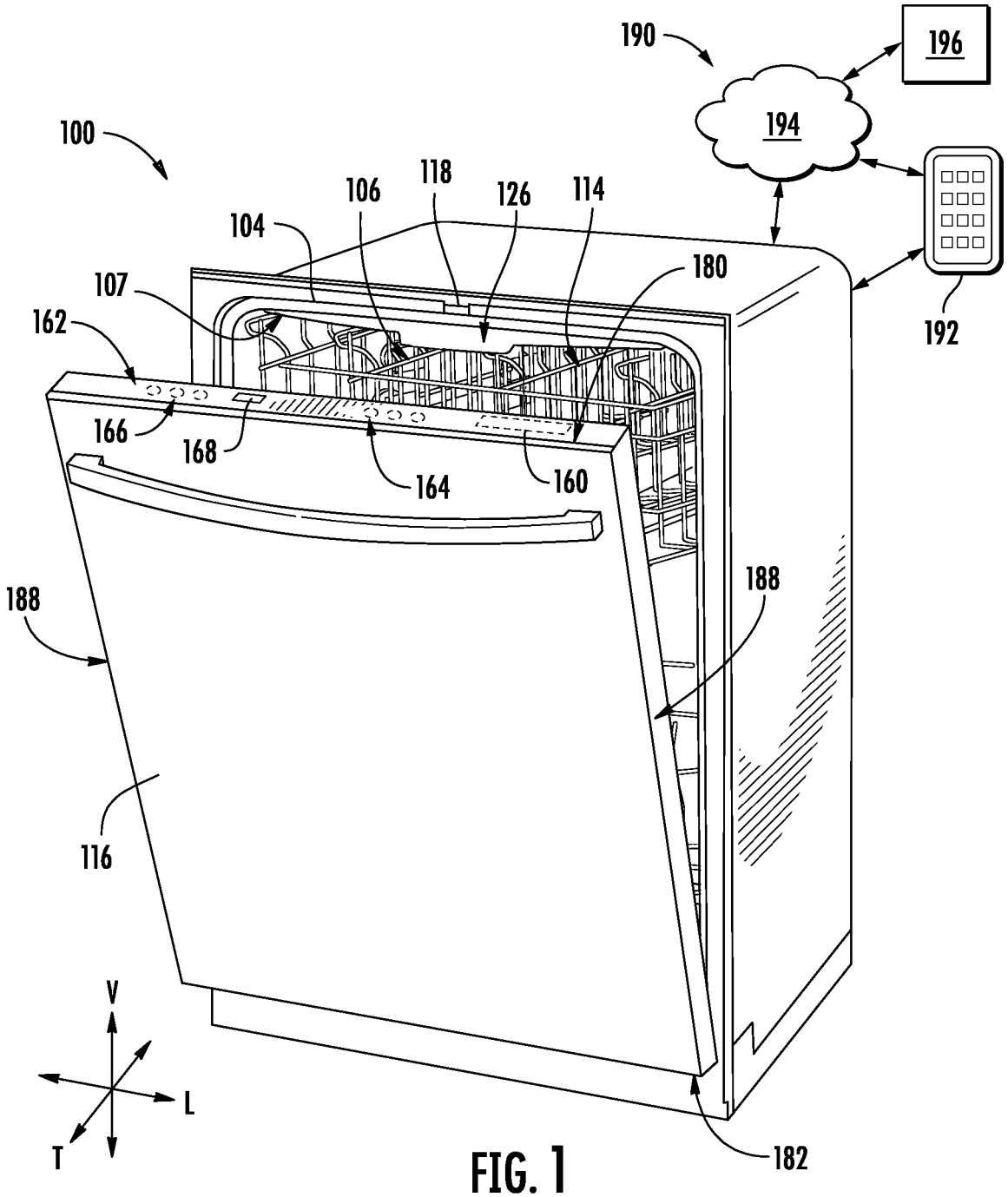
FIG. 1 provides a perspective view of a dishwasher appliance, including a dishwasher door according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. In addition, the term "or" is generally intended to be inclusive (i.e., "A or B" is intended to mean "A or B or both"). Furthermore, as used herein, terms of approximation, such as "approximately," "substantially," or "about," refer to being within a ten percent margin of error.

Figure 2:
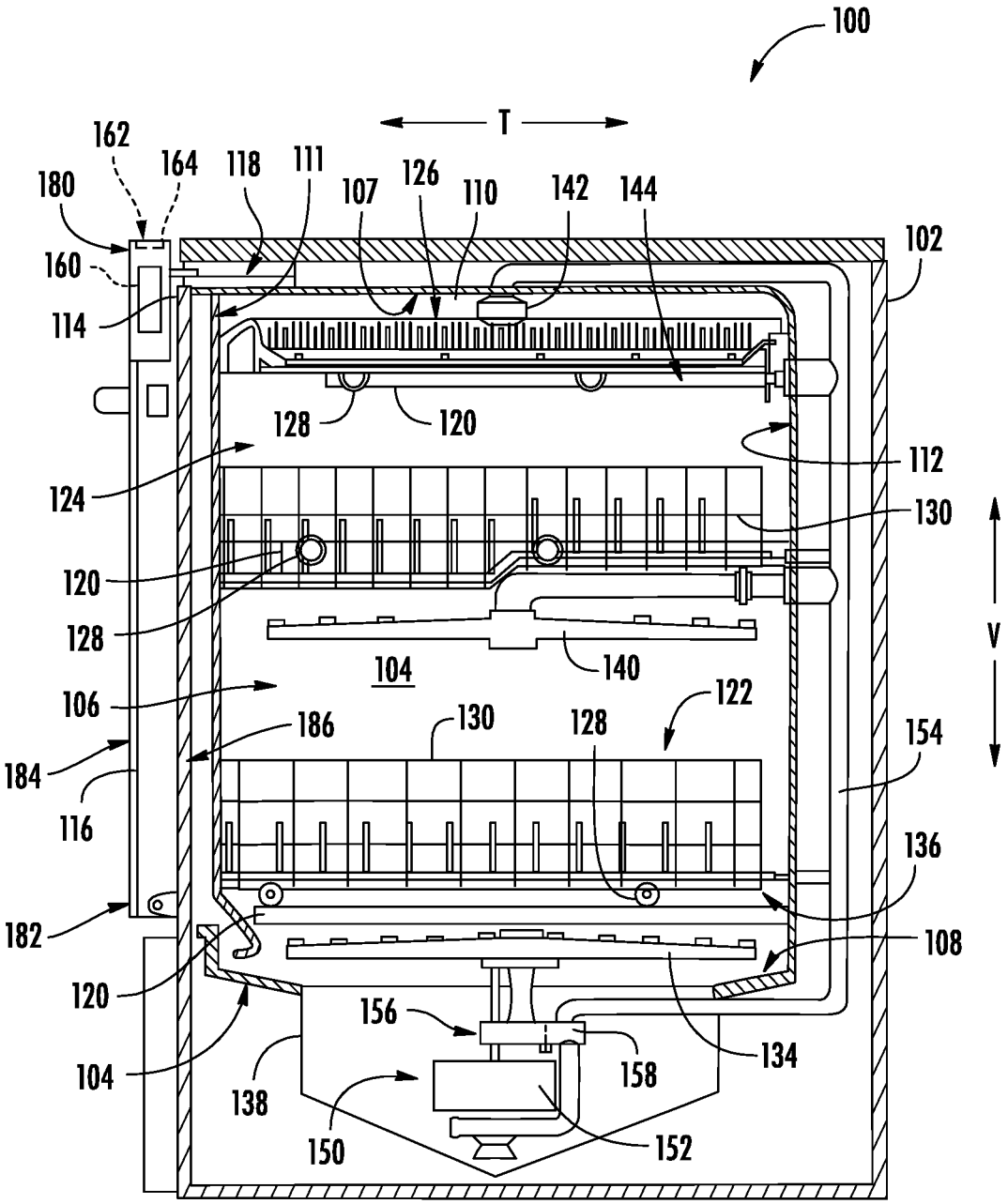
FIG. 2 provides a cross-sectional side view of the example dishwashing appliance of FIG. 1 according to an example embodiment of the present disclosure.
Figure 3:
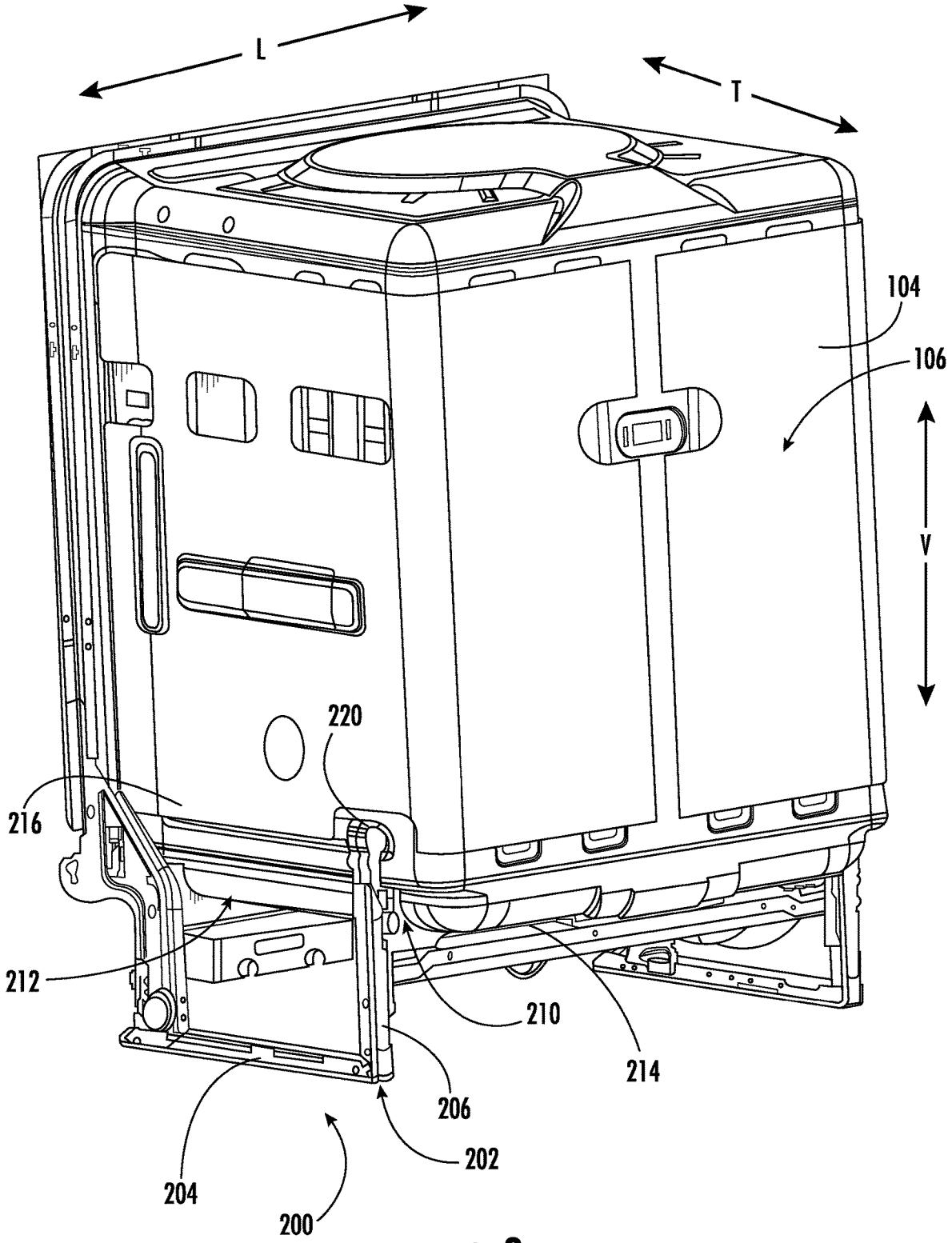
FIG. 3 provides a rear perspective view of the example dishwashing appliance of FIG. 1 showing a tub support assembly according to an example embodiment of the present subject matter.
Figure 4:
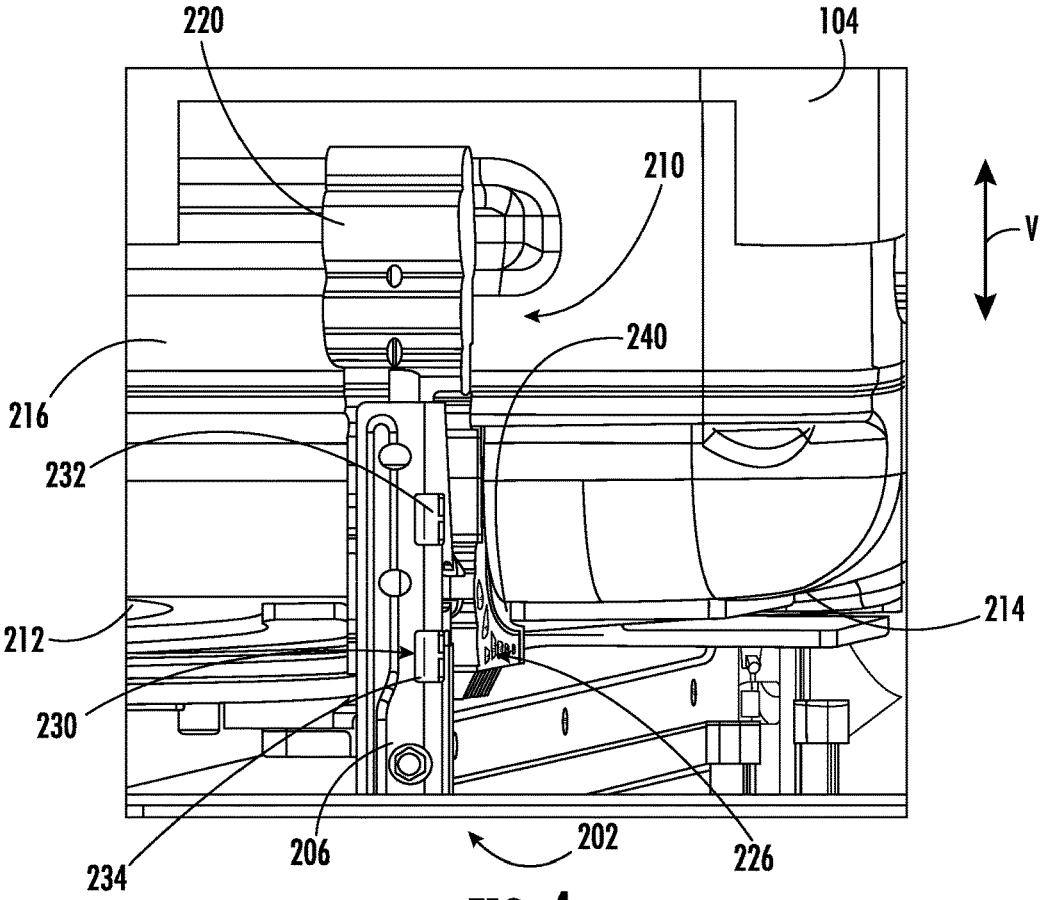
FIG. 4 provides a perspective view of the example tub support assembly of FIG. 3 according to an example embodiment of the present subject matter.
Figure 5:
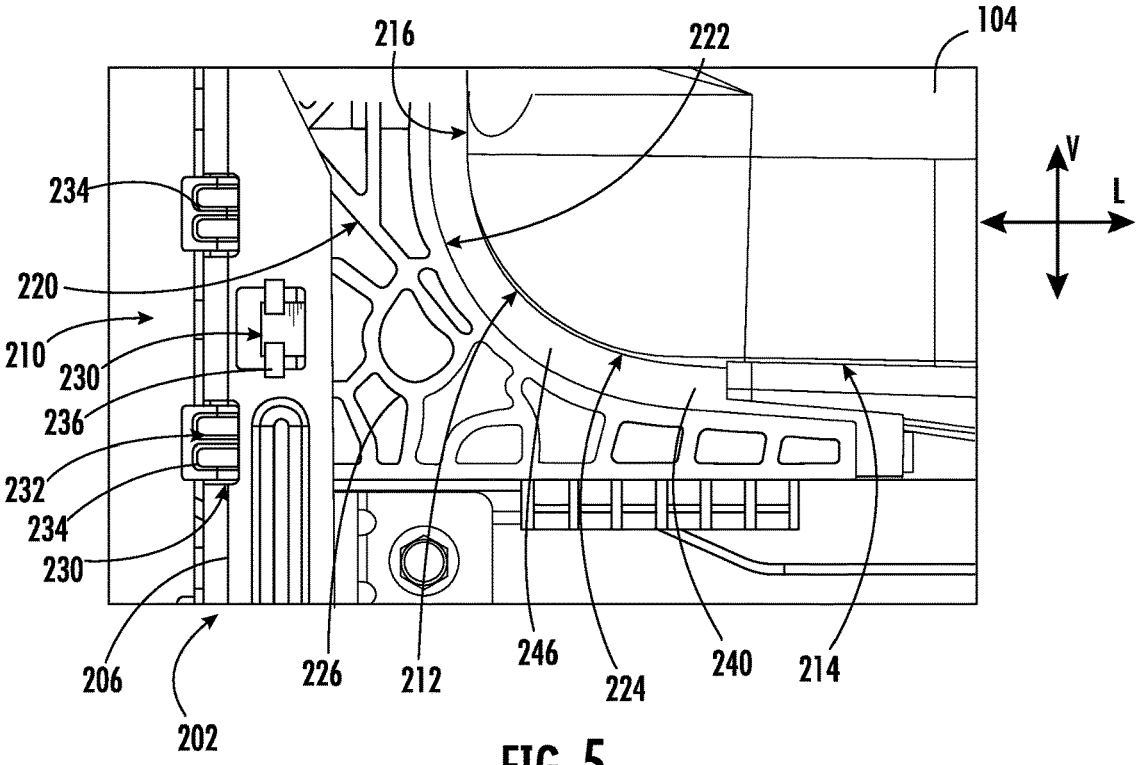
FIG. 5 provides a side view of the example tub support assembly of FIG. 3 according to an example embodiment of the present subject matter.
Figure 6:
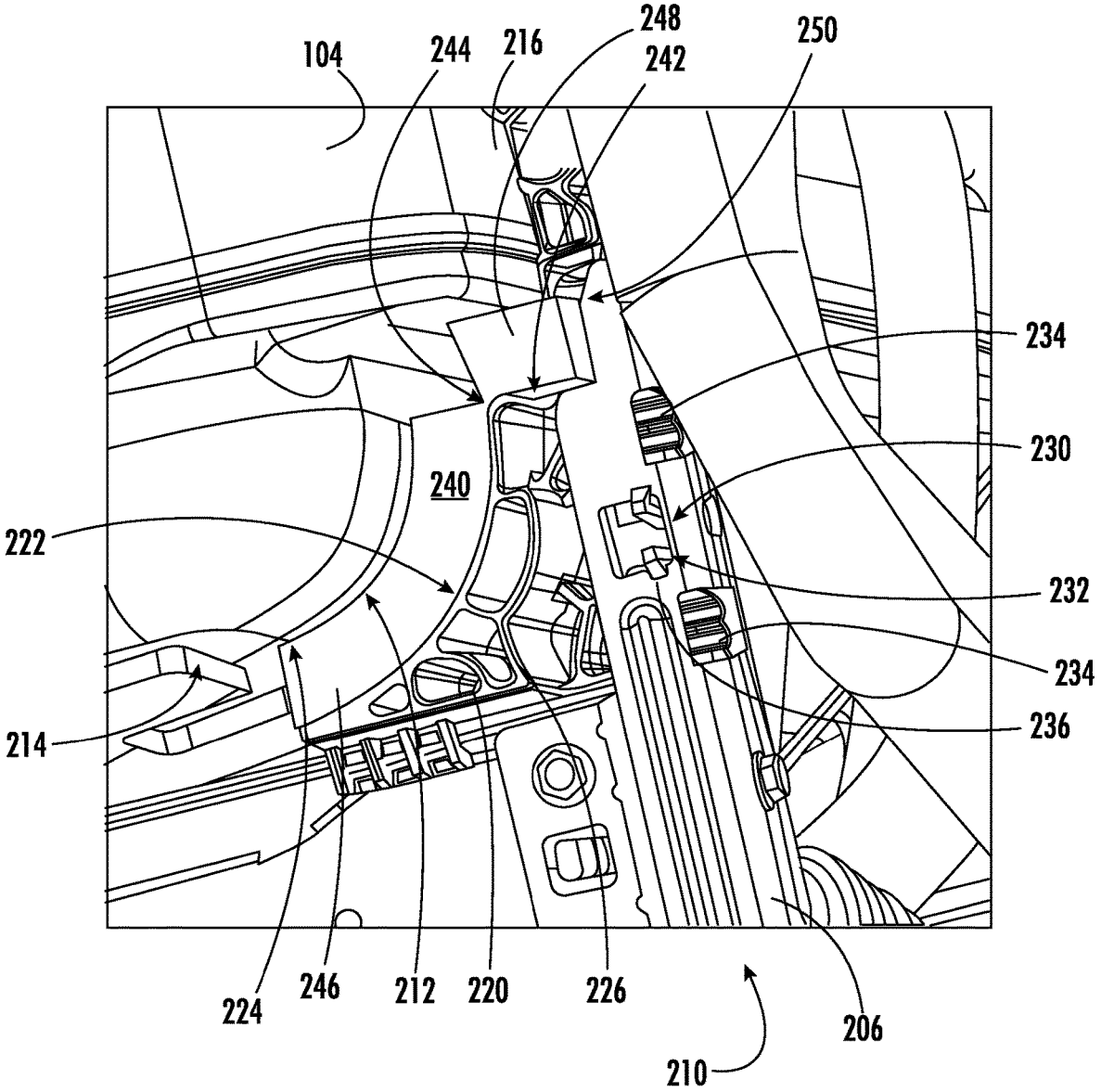
FIG. 6 provides a perspective view of the example tub support assembly of FIG. 3 according to an example embodiment of the present subject matter.
Figure 7:
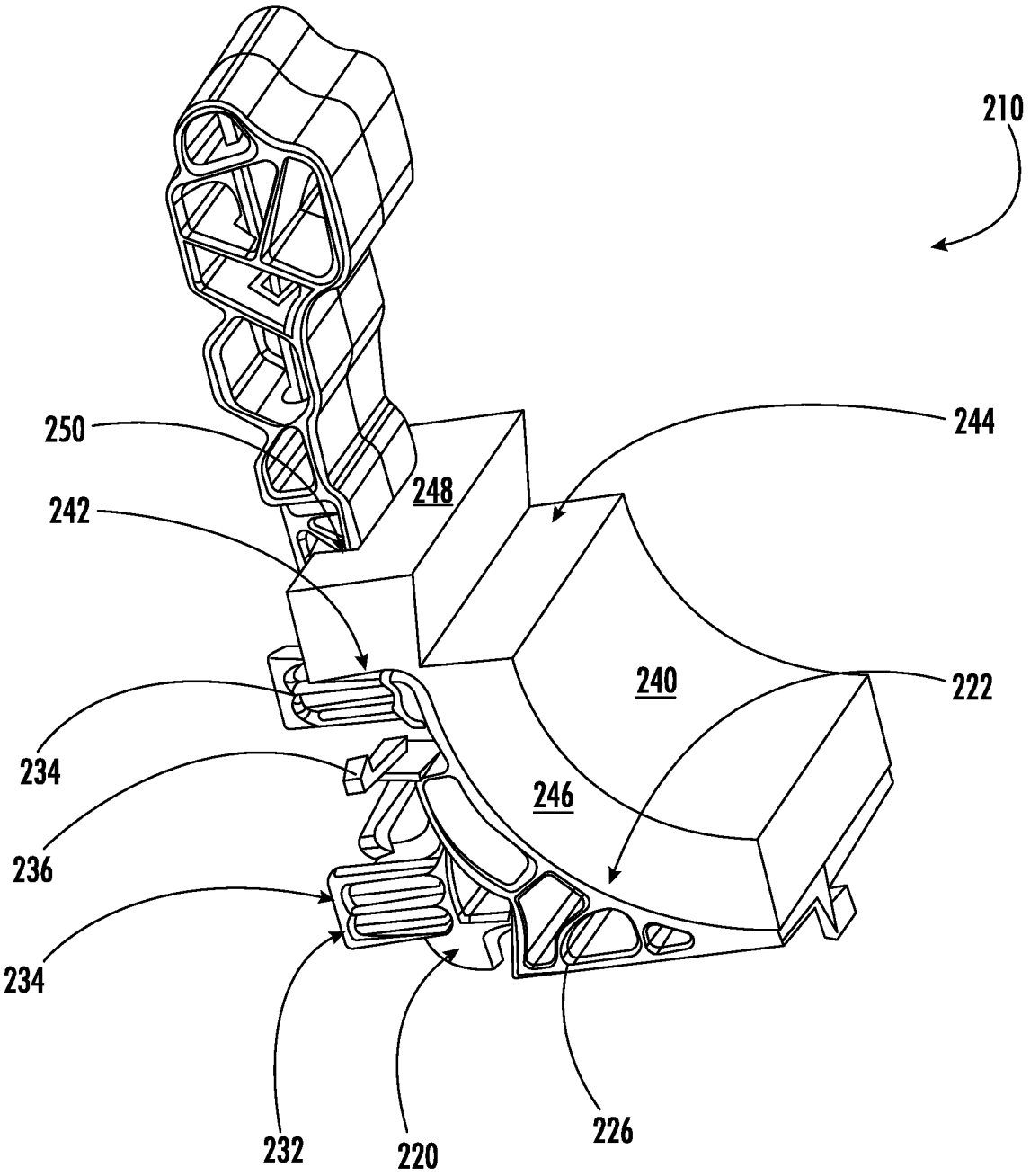
FIG. 7 provides a perspective view of a dampening tub support of the example tub support assembly of FIG. 3 according to an example embodiment of the present subject matter.
Figure 8:
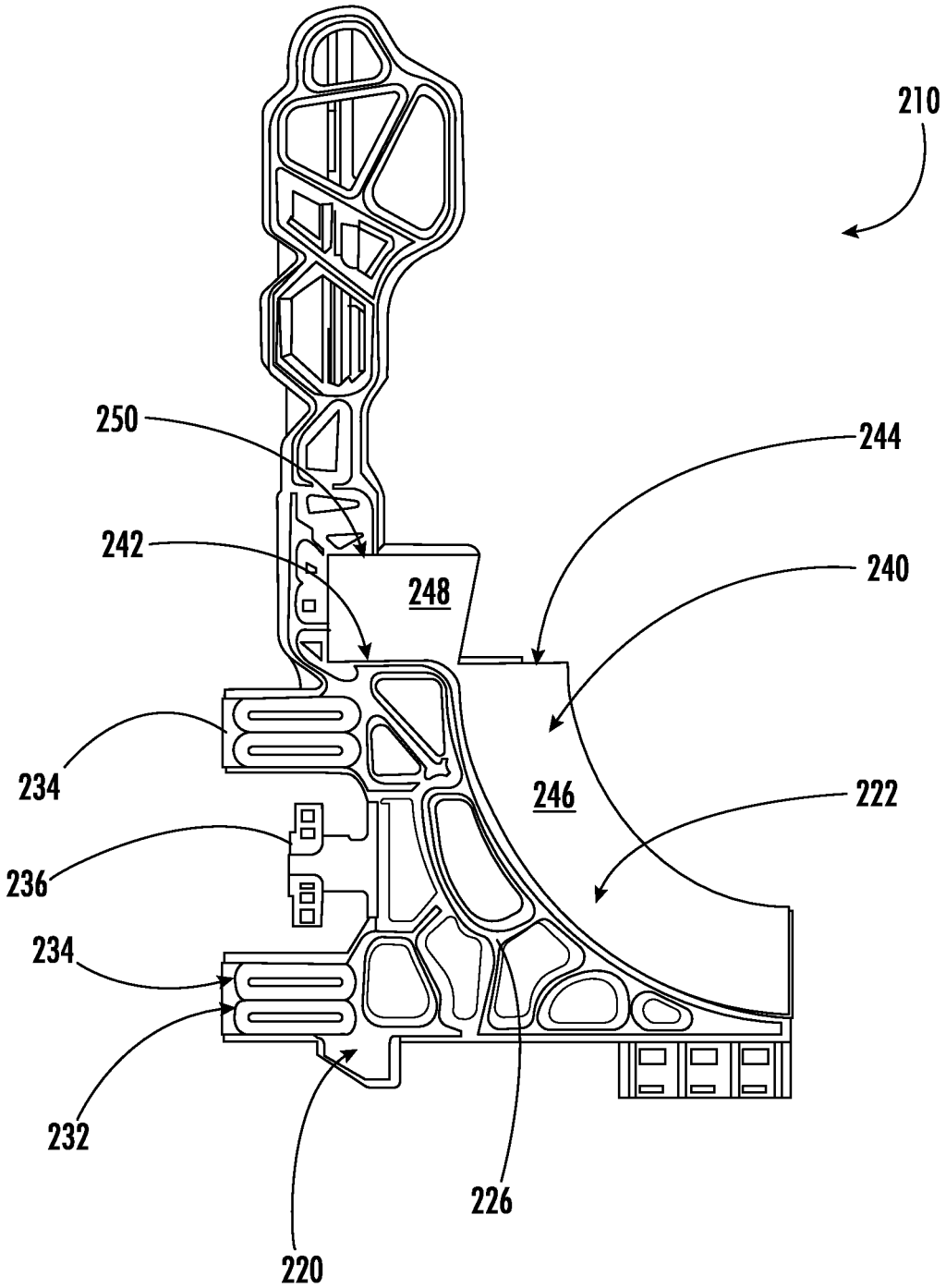
FIG. 8 provides a side view of a wash tub support of the example dampening support assembly of FIG. 3 according to an example embodiment of the present subject matter.

FIGS. 1 and 2 depict an exemplary domestic dishwashing appliance or dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. As shown, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually orthogonal to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles (e.g., during a cleaning or rinsing cycle). According to another exemplary embodiment, a silverware basket (not shown) may be removably attached to a rack assembly (e.g., lower rack assembly 122) for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water or wash fluid (e.g., detergent, water, or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies (e.g., to mid-level spray arm assembly 140 and upper spray assembly 142). However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156 (e.g., which may be positioned within sump 138 of dishwasher appliance 100). Diverter assembly 156 may include a diverter disk (not shown) disposed within a diverter chamber 158 for selectively distributing the wash fluid to the spray arm assemblies 134, 140, 142 or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level or upper spray assemblies 140, 142 (e.g., such as primary supply conduit 154).

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116, as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 may be in operative communication with a user interface panel 164 through which a user may select various operational features and modes and monitor progress of the dishwasher 100. In one embodiment, the user interface 164 may represent a general purpose I/O ("GPIO") device or functional block. In certain embodiments, the user interface 164 includes input components 166, such as one or more of a variety of electrical, mechanical or electromechanical input devices including capacitive touch screens/buttons, rotary dials, push buttons, and touch pads. The user interface 164 may further include one or more display components 168, such as a digital display device or one or more indicator light assemblies designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 1 and 2, door 116 will be described according to exemplary embodiments of the present subject matter. Although door 116 is described herein as being used with dishwasher 100, it should be appreciated that door 116 or variations thereof may be used on any other suitable residential or commercial appliance. As described herein, door 116 may share a coordinate system with dishwasher 100, e.g., when door 116 is in the closed position (e.g., as shown in FIG. 2). Specifically, door 116 may define a vertical direction V, a lateral direction L, and a transverse direction T. Therefore, these directions may be used herein to refer to features of door 116 and its various components and sub-assemblies.

As shown, in the normally closed position, door 116 extends from a top end or top edge 180 to a bottom end or bottom edge 182 along the vertical direction V; from a front end 184 to a rear end 186 along the transverse direction T; and between two lateral ends 188 along the lateral direction L. According to exemplary embodiments, door 116 may be formed from one or more exterior panels that define an interior chamber of door 116. According to exemplary embodiments, the exterior panels of door 116 may be panels that are stamped from stainless steel or may be formed from any other suitably rigid material, such as thermoformed plastic, other metals, etc. In general, the exterior panels of door 116 may be assembled in any suitable manner, e.g., may be secured together using any suitable mechanical fastener, welding, snap-fit mechanisms, etc. In addition, it should be appreciated that an insulating material (not shown), such as fiberglass or foam insulation, may be positioned within door 116 to provide thermal and/or sound insulation to dishwasher 100.

Referring still to FIGS. 1 and 2, user interface panel 164 is positioned proximate top edge 180 of door 116 along the vertical direction V. In this manner, user interface panel 164 may be partially hidden below a countertop when dishwasher appliance 100 is installed below the countertop and door 116 is closed. Accordingly, dishwasher appliance 100 may be referred to as a "top control dishwasher appliance." However, it should be appreciated that aspects of the present subject matter may be used with dishwasher appliances having other configurations or any other suitable appliance. For example, user interface panel 164 may be alternately positioned on front face or front end 184 of door 116.

User interface panel 164 is positioned on door 116 such that a user can engage or interact with user interface panel 164, e.g., to select operating cycles and parameters, activate/deactivate operating cycles, or adjust other operating parameters of dishwasher appliance 100. User interface panel 164 may include a printed circuit board (not shown) that is positioned within door 116. According to exemplary embodiments, printed circuit board may include or be operatively coupled to controller 160 and/or user interface panel 164. In addition, user interface panel 164 may include or be operably coupled to one or more user inputs or touch buttons (e.g., identified generally herein as user inputs 166) for receiving user input, providing user notifications, or illuminating to indicate cycle or operating status.

Specifically, according to the illustrated embodiment, user inputs 166 include a plurality of capacitive sensors that are mounted to user interface panel 164 and are operable to detect user inputs. For example, these capacitive sensors may be configured for triggering when a user touches a top edge 180 of user interface panel 164 in a region associated with a particular user input 166. In particular, these capacitive sensors can detect when a finger or another conductive material with a dielectric different than air contacts or approaches user interface panel 164, along with the precise location, pressure, etc. of the finger interaction.

When a user touches top edge 180 of user interface panel 164 adjacent one of user inputs 166, the associated capacitive sensors may be triggered and may communicate a corresponding signal to controller 160. In such a manner, operations of dishwasher appliance 100 can be initiated and controlled. According to exemplary embodiments, the capacitive sensors may be distributed laterally on user interface panel 164. It will be understood that other any suitable number, type, and position of capacitive sensors may be used while remaining within the scope of the present subject matter. Indeed, any suitable number, type, and configuration of user inputs 166 may be used while remaining within the scope of the present subject matter.

User interface panel 164 may define a plurality of surfaces that are intended to be illuminated for various purposes. For example, user inputs 166 may be illuminated by light sources to inform the user of the location of the button or to provide some other status indication. Notably, this illumination is typically achieved by directing a light beam along the vertical direction V onto top edge 180 of user interface panel 164. Door 116 may further include a plurality of light sources or lighting devices that are configured for illuminating one or more surfaces of user interface panel 164. It should be appreciated that these light sources may include any suitable number, type, configuration, and orientation of light sources mounted at any suitable location to illuminate status indicators or buttons in any suitable colors, sizes, patterns, etc. In other words, the light sources may be provided as any suitable number, type, position, and configuration of electrical light source(s), using any suitable light technology and illuminating in any suitable color. For example, the light sources may include one or more light emitting diodes (LEDs), which may each illuminate in a single color (e.g., white LEDs), or which may each illuminate in multiple colors (e.g., multi-color or RGB LEDs) depending on the control signal from controller 160.

However, it should be appreciated that according to alternative embodiments, the light sources may include any other suitable traditional light bulbs or sources, such as halogen bulbs, fluorescent bulbs, incandescent bulbs, glow bars, a fiber light source, etc. Moreover, the light sources may be operably coupled (e.g., electrically coupled) to controller 160 or another suitable control board to facilitate activation or illumination of the light sources (e.g., to indicate a user input, state of the dishwasher appliance, state of the wash cycle, or any other relevant information to a user).

According to exemplary embodiments, user interface panel 164 may be any suitable transparent or semitransparent feature for diffusing, directing, or otherwise transmitting light from a light source. For example, user interface panel 164 may be formed from a suitable transparent or translucent material configured to direct light energy, such as a dielectric material, such as glass or plastic, polycarbonate, polypropylene, polyacrylic, or any other suitable material.

In addition, user interface panel 164 may be a dead fronted panel. As used herein, the term "dead front" and the like is generally intended to refer to portions of a control panel which may be used as indicators, buttons, interactive control surfaces, or other user-interaction features without exposing the user to the operating side of the equipment or live parts and connections, i.e., lights, electrical connections, etc. For example, user interface panel 164 may include a transparent or translucent body and an opaque masking material that is selectively printed on top edge 180 of the translucent body to define capacitive touch buttons or user inputs 166.

The opaque material may be deposited on the translucent body to define any suitable number, size, and configuration of illuminated features. These illuminated features may be shapes or include other forms such as symbols, words, etc. that are visible on user interface panel 164. More specifically, when light sources are energized, capacitive touch buttons or user inputs 166 on top edge 180 may be illuminated. Thus, the dead fronted top edge 180 may be the surface that is contacted for controlling dishwasher appliance 100 or which may be illuminated for purposes of indicating operating status or other conditions to the user of the dishwasher appliance 100.

Referring still to FIG. 1, a schematic diagram of an external communication system 190 will be described according to an exemplary embodiment of the present subject matter. In general, external communication system 190 is configured for permitting interaction, data transfer, and other communications between dishwasher appliance 100 and one or more external devices. For example, this communication may be used to provide and receive operating parameters, user instructions or notifications, performance characteristics, user preferences, or any other suitable information for improved performance of dishwasher appliance 100. In addition, it should be appreciated that external communication system 190 may be used to transfer data or other information to improve performance of one or more external devices or appliances and/or improve user interaction with such devices.

For example, external communication system 190 permits controller 160 of dishwasher appliance 100 to communicate with a separate device external to dishwasher appliance 100, referred to generally herein as an external device 192. As described in more detail below, these communications may be facilitated using a wired or wireless connection, such as via a network 194. In general, external device 192 may be any suitable device separate from dishwasher appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with dishwasher appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control dishwasher appliance 100, etc. In addition, external device 192 and remote server 196 may communicate with dishwasher appliance 100 to communicate similar information.

In general, communication between dishwasher appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with dishwasher appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now generally to FIGS. 3 through 6, dishwasher appliance 100 may further include a wash tub support assembly 200 for receiving and supporting wash tub 104. For example, wash tub support assembly 200 may include an apron frame 202 which includes one or more structural members for supporting the weight of dishwasher 100 during operation. According to the illustrated embodiment of FIG. 3, apron frame 202 may include base members 204 that are positioned on opposite lateral sides of dishwasher 100 and are configured for seating on the floor where dishwasher appliance 100 is installed. In addition, apron frame 202 may include vertical supports 206 that extend from a rear end of each of the base members 204 upward along the vertical direction V. Vertical supports 206 are generally configured for supporting wash tub 104. As shown for example in FIGS. 1 and 2, apron frame 202 may generally be covered in an apron or cabinet structure (e.g., referred to herein generally as cabinet 102).

Notably, as explained briefly above, apron frame 202 (or more specifically, vertical supports 206) may have a tendency to damage wash tub 104 when large impacts are made to apron frame 202. For example, during delivery of dishwasher appliance 100, apron frame 202 often experiences large impacts associated with the movement of dishwasher appliance 100. These impact forces tend to travel up vertical supports 206 and directly transfer to wash tub 104. Because wash tub 104 is commonly formed from a thin metal material, dents, deformations, and other damage to wash tub 104 may occur. Accordingly, aspects of the present subject matter are generally directed to features for reducing the transfer of such impact forces on to wash tub 104.

In this regard, wash tub support assembly 200 may further include a dampening tub support 210 that is positioned between apron frame 202 and wash tub 104. Although an exemplary dampening tub support 210 is described below, it should be appreciated that variations and modifications may be made while remaining within the scope of the present subject matter. As illustrated, dampening tub support 210 may generally be mounted to a top end of vertical supports 206 and may support a lower corner 212 where a bottom wall 214 and a sidewall 216 of wash tub 104 meet. More specifically, dampening tub supports 210 may be positioned at lower corners 212 on opposite ends of wash tub 104 along the lateral direction L. Although two dampening tub supports 210 are illustrated, it should be appreciated that wash tub support assembly 200 may further include additional vertical supports 206 and dampening tub supports 210 as needed to sufficiently and safely support wash tub 104.

As shown in FIGS. 3 through 8, dampening tub support 210 generally includes a mounting structure 220 that is attached to apron frame 202 (e.g., at a distal end of vertical supports 206). In general, mounting structure 220 may define a tub support surface 222 that is configured for securely supporting wash tub 104. In this regard, for example, tub support surface 222 may be contoured to match a contact surface 224 of wash tub 104 (e.g., a profile of corner 212). For example, according to the illustrated embodiment, dampening tub support 210 is positioned on arcuate corner 212 where bottom 214 and sidewall 216 of wash tub 104 meet. Accordingly, tub support surface 222 may also be curved or arcuate in a manner that matches the contour of corner sidewall 212 of wash tub 104. In this manner, pressure points may be reduced and wash tub 104 may be securely supported to reduce vibrations and mitigate impact forces.

It should be appreciated that various features of mounting structure 220 and dampening tub support 210 may be formed from any suitably rigid material. For example, according to exemplary embodiments, mounting structure 220 may be formed by injection molding, e.g., using a suitable plastic material, such as injection molding grade Polybutylene Terephthalate (PBT), Nylon 6, high impact polystyrene (HIPS), acrylonitrile butadiene styrene (ABS), or any other suitable blend of polymers. Alternatively, according to the exemplary embodiment, these components may be compression molded, e.g., using sheet molding compound (SMC) thermoset plastic or other thermoplastics. According to still other embodiments, portions of mounting structure 220 may be formed from any other suitable rigid material.

Although mounting structure is formed from a rigid or semi rigid material, it should be appreciated that according to example embodiments, it may be desirable to absorb impact forces within mounting structure 220. Accordingly, mounting structure 220 may define a geometry that is intended to support wash tub 104 while minimizing the transfer of impact forces on apron frame 202. For example, according to the illustrated embodiment, mounting structure 220 defines a cellular structure 226 that allows flexing of the injection molded plastic mounting structure 220 to absorb impact forces. In this regard, cellular structure 226 may be a honeycomb structure, a cellular matrix structure, or any other suitable grid, lattice, or mesh-like structure capable of absorbing impact forces.

In general, mounting structure 220 may be attached to vertical supports 206 in any suitable manner. In this regard, mounting structure 220 may be attached to the vertical supports 206 using mechanical fasteners, adhesive, welding, or any other suitable attachment mechanism. For example, according to the illustrated embodiment, apron frame 202 may define one or more attachment apertures 230 and mounting structure 220 may define complementary features 232 for receipt within attachment apertures 230. For example, referring specifically to FIGS. 6 through 8, mounting structure 220 may define two rigid protrusions 234 and one resilient snap fit mechanism 236 that are configured for engaging attachment apertures 230 of vertical supports 206.

As best shown in FIGS. 5 through 8, dampening tub support 210 may further include a resilient member 240 that lines tub support surface 222 of mounting structure 220 for providing cushioned engagement between mounting structure 220 and wash tub 104. In this regard, resilient member 240 may be any suitable impact in vibration absorbing material, such as foam. In general, resilient member 240 may contact both a bottom wall 214 and a sidewall 216 of wash tub 104. In addition, resilient member 240 may be designed to completely prevent physical contact between mounting structure 220 and wash tub 104. Although an exemplary resilient member 240 described below, it should be appreciated that variations and modifications may be made while remaining within the scope of the present subject matter.

Notably, mounting structure 220 and resilient member 240 may have specific geometries that facilitates improved impact force reduction, simplified assembly, and reduced likelihood of wash tub 10 displacing resilient member 240 relative to mounting structure 220. In this regard, for example, mounting structure 220 may generally define a horizontal shelf 242 that is positioned above tub support surface 222. According to the illustrated embodiment, resilient member 240 covers both tub support surface 222 and a horizontal shelf 242. In this manner, the engagement between resilient member 240 and horizontal shelf 242 may prevent the likelihood of resilient member 240 sliding down mounting structure 220 as wash tub 104 is seated therein.

In addition, it should be appreciated that resilient member 240 may be formed from a single piece of foam that is formed to mounting structure 220. In addition, a notch 244 may be cut in resilient member 240 to prevent a stress-free transition between tub support surface 222 and horizontal shelf 242. For example, notch 244 may separate a lower portion 246 of resilient member 240 from an upper portion 248 of resilient member 240. In general, lower portion 246 conforms to tub support surface 222 of mounting structure 220 while upper portion 248 is seated flat against horizontal shelf 242.

In addition, according to example embodiments, resilient member 240 may include a plurality of slits that permit resilient member to conform to tub support surface 222 of mounting structure 210. These slits may be defined on a bottom of resilient member 240 where it seats against mounting structure 210 to allow for maximum flexibility in matching the contoured shape of mounting structure 210. In addition, resilient member 240 may define one or more notches that help locate resilient member 240 relative to mounting structure 210. Furthermore, an adhesive may be used to help resilient member 240 stick permanently to mounting structure 210.

Dampening tub support 210 may include other features to ensure that resilient member 240 stays in place on mounting structure 220 during installation of wash tub 104 and throughout installation and operation of dishwasher appliance 100. For example, according to the illustrated embodiment, mounting structure 220 may generally define an upper slot 250 that is configured for securing upper portion 248 of resilient member 240. In this regard, upper portion 248 may slide into upper slot 250 where further movement is prevented. In addition, it should be appreciated that other adhesives, attachment structures, and other features may be used to ensure resilient member 240 stays firmly seated on mounting structure 220. Other variations and modifications to dampening tub support 210 are possible and within the scope of the present subject matter.

As explained above, aspects of the present subject matter are generally directed to a tub support member that is designed to absorb impacts commonly associated with the delivery or installation of a dishwasher appliance. For example, the tub support member may include a rigid plastic component that attaches to the cabinet or an apron support member and defines a conforming surface to the bottom of the wash tub. In addition, a resilient foam member may be attached to the rigid plastic component for contacting the wash tub and absorbing impacts from installation and/or undesirable vibrations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

an apron frame;

a wash tub positioned on top of the apron frame and defining a wash chamber for receipt of a load of articles; and a dampening tub support positioned between the apron frame and the wash tub, the dampening tub support comprising:

a mounting structure that is attached to the apron frame and defines a tub support surface for supporting the wash tub, wherein the tub support surface is contoured to match a contact surface on the wash tub, and wherein mounting structure defines a horizontal shelf positioned above the tub support surface; and a resilient member lining the tub support surface between the mounting structure and the wash tub, wherein the resilient member covers both the tub support surface and the horizontal shelf.

2. The dishwasher appliance of claim 1, wherein the mounting structure is an injection molded plastic.

3. The dishwasher appliance of claim 2, wherein the mounting structure defines a cellular structure that allows flexing of the injection molded plastic to absorb impact forces.

4. The dishwasher appliance of claim 1, wherein the resilient member defines a notch that separates a lower portion of the resilient member from an upper portion of the resilient member, and wherein the upper portion of the resilient member is seated flat against the horizontal shelf.

5. The dishwasher appliance of claim 4, wherein the mounting structure defines an upper slot for securing the upper portion of the resilient member.

6. The dishwasher appliance of claim 1, wherein the resilient member is a foam material.

7. The dishwasher appliance of claim 1, wherein the resilient member contacts both a bottom wall and a sidewall of the wash tub.

8. The dishwasher appliance of claim 1, wherein the dampening tub support is positioned on a side corner of the wash tub.

9. The dishwasher appliance of claim 1 wherein the dampening tub support is a first dampening tub support positioned on a first side of the wash tub, the dishwasher appliance further comprising a second tub support positioned on a second side of the wash tub.

10. The dishwasher appliance of claim 1, wherein the apron frame defines an attachment aperture and the mounting structure defines a snap fit geometry for receipt within the attachment aperture.

11. A wash tub support assembly for a dishwasher appliance, the dishwasher appliance comprising a wash tub defining a wash chamber for receipt of a load of articles, the wash tub support assembly comprising:

an apron frame defining an attachment aperture; and a dampening tub support positioned between the apron frame and the wash tub, the dampening tub support comprising:

a mounting structure that is attached to the apron frame and defines a tub support surface for supporting the wash tub, wherein the mounting structure defines a snap fit geometry for receipt within the attachment aperture; and a resilient member lining the tub support surface between the mounting structure and the wash tub.

12. The wash tub support assembly of claim 11, wherein the mounting structure is an injection molded plastic and the mounting structure defines a cellular structure that allows flexing of the injection molded plastic to absorb impact forces.

13. The wash tub support assembly of claim 11, wherein the tub support surface is contoured to match a contact surface on the wash tub.

14. The wash tub support assembly of claim 13, wherein mounting structure defines a horizontal shelf positioned above the tub support surface, and wherein the resilient member covers both the tub support surface and the horizontal shelf.

15. The wash tub support assembly of claim 14, wherein the resilient member defines a notch that separates a lower portion of the resilient member from an upper portion of the resilient member, and wherein the upper portion of the resilient member is seated flat against the horizontal shelf.

16. The wash tub support assembly of claim 15, wherein the mounting structure defines an upper slot for securing the upper portion of the resilient member.

17. The wash tub support assembly of claim 11, wherein the resilient member is a foam material that contacts both a bottom wall and a sidewall of the wash tub.

18. A dishwasher appliance defining a vertical direction, a lateral direction, and a transverse direction, the dishwasher appliance comprising:

an apron frame;

a wash tub positioned on top of the apron frame and defining a wash chamber for receipt of a load of articles; and a first dampening tub support positioned between the apron frame and the wash tub on a first side of the wash tub and a second dampening tub support positioned between the apron frame and the wash tub on a second side of the wash tub, the first dampening tub support and the second dampening tub support each comprising:

a mounting structure that is attached to the apron frame and defines a tub support surface for supporting the wash tub; and a resilient member lining the tub support surface between the mounting structure and the wash tub.

19. The dishwasher appliance of claim 18, wherein the mounting structure is an injection molded plastic.

20. The dishwasher appliance of claim 19, wherein the mounting structure defines a cellular structure that allows flexing of the injection molded plastic to absorb impact forces.

* * * * *